US006754910B2

(12) United States Patent
Shultz et al.

(10) Patent No.: US 6,754,910 B2
(45) Date of Patent: Jun. 29, 2004

(54) CAMOUFLAGE COMPOSITION AND METHOD OF MAKING

(76) Inventors: Scott S. Shultz, c/o Robinson Laboratories, Inc., 110 N. Park Dr., Cannon Falls, MN (US) 55009; Alan Lee, c/o Robinson Laboratories, Inc., 110 N. Park Dr., Cannon Falls, MN (US) 55009

( * ) Notice: Subject to any disclaimer, the term of this patent is extended or adjusted under 35 U.S.C. 154(b) by 217 days.

(21) Appl. No.: 10/155,599

(22) Filed: May 24, 2002

(65) Prior Publication Data

US 2003/0217406 A1 Nov. 27, 2003

(51) Int. Cl.[7] ..... A41D 27/08

(52) U.S. Cl. ..... 2/244; 2/94; 2/900; 428/15; 428/919

(58) Field of Search ..... 2/94, 244, 900; 428/15–20, 22, 27, 919, 114, 115, 119, 120, 187, 189, 190

(56) References Cited

U.S. PATENT DOCUMENTS

| | | | | | |
|---|---|---|---|---|---|
| 2,524,895 | A | | 10/1950 | Dodge | |
| 3,069,796 | A | | 12/1962 | Ruter | |
| 3,395,066 | A | | 7/1968 | Tucker | |
| 3,703,432 | A | | 11/1972 | Koski | |
| 3,769,120 | A | | 10/1973 | Chandler | |
| 3,790,652 | A | | 2/1974 | Colijn | |
| 3,977,927 | A | | 8/1976 | Amos | |
| 4,034,375 | A | | 7/1977 | Wallin | |
| 4,323,605 | A | | 4/1982 | Rush | |
| 4,347,284 | A | | 8/1982 | Tsutomu | |
| 4,364,156 | A | | 12/1982 | Greenway | |
| 4,375,488 | A | | 3/1983 | Hogan | |
| 4,418,451 | A | | 12/1983 | Crenshaw | |
| 4,471,514 | A | | 9/1984 | Stokes | |
| 4,493,863 | A | | 1/1985 | Karlsson | |
| 4,517,230 | A | * | 5/1985 | Crawford | 428/17 |
| 4,656,065 | A | | 4/1987 | Yacovella | |
| 4,767,649 | A | | 8/1988 | Birch | |
| 4,931,320 | A | | 6/1990 | Leonard | |
| 4,940,619 | A | | 7/1990 | Smith | |
| 5,013,375 | A | | 5/1991 | Leonard | |
| 5,043,202 | A | * | 8/1991 | Knickerbocker | 428/195.1 |
| 5,203,033 | A | * | 4/1993 | Sheppard et al. | 2/69 |
| 5,261,978 | A | | 11/1993 | Reynolds | |
| 5,281,451 | A | | 1/1994 | Reynolds | |
| 5,347,659 | A | * | 9/1994 | Tibljas | 2/84 |
| 5,445,863 | A | | 8/1995 | Slagle | |
| 5,476,561 | A | | 12/1995 | Bylund | |
| 5,486,385 | A | | 1/1996 | Bylund | |
| 5,695,835 | A | | 12/1997 | Weber | |
| 5,753,323 | A | * | 5/1998 | Andrus | 428/17 |
| 5,920,903 | A | * | 7/1999 | Koehntop et al. | 2/69 |
| 5,958,526 | A | * | 9/1999 | Spickelmire | 428/17 |
| 6,675,394 | B2 | * | 1/2004 | Egnew | 2/227 |

FOREIGN PATENT DOCUMENTS

| | | |
|---|---|---|
| CH | 347737 | 7/1960 |
| DE | 1034070 | 7/1958 |

* cited by examiner

*Primary Examiner*—John J. Calvert
*Assistant Examiner*—Robert H. Muromoto, Jr.
(74) *Attorney, Agent, or Firm*—Patterson, Thuente, Skaar & Christensen, P.A.

(57) ABSTRACT

A camouflage composition includes a plurality of fabric strips, each strip having a body portion and at least one fringed portion, said at least one fringed portion arranged along a margin of the strip, the first surface of the body portion of each fabric strip affixed to the first surface of the body portion of a separate one of said plurality of fabric strips along a seam, said seam being oriented adjacent said fringed portion of each strip, whereby the body portions of each of said plurality of fabric strips form a continuous material and said fringed portions extend outwardly from said continuous material to form a three-dimensional camouflage effect. A garment made at least in part of the camouflage composition and a method of making the camouflage composition are further included.

39 Claims, 5 Drawing Sheets

CAMOUFLAGE COMPOSITION AND METHOD OF MAKING

TECHNICAL FIELD

The present invention relates to camouflage materials for forming camouflage net systems, garments and the like. More particularly, the present invention relates to a camouflage composition that has a three-dimensional (3-D) appearance.

BACKGROUND OF THE INVENTION

Camouflage materials have long been employed to conceal objects, personnel, and equipment in various terrains from visual detection. Generally, such camouflage materials for concealing objects and equipment are drapable two-dimensional sheets or net structures of varying size and shape, and are solid color or imprinted in multiple color patterns. For concealing personnel, such camouflage materials are formed into a plurality of different garments including, but not limited to: jackets, pullovers, parkas, coveralls, bibs, and pants.

In recent years, in an effort to enhance concealment, efforts have been directed toward adding a third dimension to such camouflage materials. To that end, two companion patents, U.S. Pat. Nos. 4,931,320 and 5,013,375, both to Robert R. Leonard, are directed to a camouflage material (the '320 patent) and to a method and apparatus for producing the material (the '375 patent).

The aforementioned material is a camouflage construction having an open mesh net substrate, and a continuous sheet overlying the substrate and bonded thereto along plural spaced lines of attachment. The sheet is cut on opposite sides of the lines of attachment to form a plurality of lobes. The apparatus and method includes a sewing station for stitching the sheet along plural spaced lines of attachment to the substrate to form open-ended pockets for channels between the sheet and substrate. The cutting station spaces the sheet from the substrate and a heated cutting wire reciprocates between adjacent lines of stitches to cut the sheet and open the channel to form a series of loose lobes. A problem with such construction is that the lobes were cut from an essentially flat, two-dimensional material having a substantially flat set to the material. Notwithstanding the fact that the ends of the lobes were free, the lobes tended to lie flat against the substrate, thereby defeating the sought-for three-dimensional effect.

In an effort to remedy this, two additional patents have issued. Significantly, both of those patents utilize the material, apparatus, and method of the aforementioned '320 and '375 patents. The later patents are U.S. Pat. No. 5,281,451 to James R. Reynolds and U.S. Pat. No. 5,486,385 to Don M. Bylund et al. In the '451 patent, a camouflage construction is formed having an open mesh net substrate, and a continuous sheet overlying the substrate and bonded thereto along plural spaced lines of attachment. The sheet is cut on opposite sides of the lines of attachment to form a plurality of lobes. The fabric is heated and the lobes folded and creased to increase the openness of the fabric.

The fabric of the '385 patent is an open mesh, net substrate to which is bonded a sheet material. The sheet is colored in the desired pattern and bonded to the substrate along spaced lines of attachment. Separate lobes are formed on each side of the lines of stitching (attachment) to simulate the appearance of natural objects of the terrain. The lobes are then heated to over 400° F. to wrinkle and de-luster the camouflage lobes to increase the three-dimensional effect and significantly decrease luster.

It is significant to note that, in all four of the aforementioned patents, the construction has an open mesh net substrate and a continuous sheet overlying the substrate and bonded thereto along plural spaced lines of attachment. The sheet is then cut on opposite sides of the lines of attachment to form a plurality of lobes.

Notwithstanding the efforts shown in the aforementioned four patents in forming a composition that has a three-dimensional effect, there is still a need in the industry for camouflaged fabric having a definite and naturally appearing three-dimensional effect.

SUMMARY OF THE INVENTION

The present invention substantially meets the aforementioned need of the industry. Definite three-dimensional camouflage effect is created without the need to heat, fold, or crease any of the material used to form the camouflage composition. The three-dimensional effect is created simply by the manner in which individual strips are cut and attached together. With the present invention a material having a three-dimensional camouflage effect is produced in a single layer, and without the need for any separate substrate or underlying base as required in each of the patents noted above.

The present invention may be characterized in one embodiment as a composite camouflage composition which comprises a plurality of camouflage members. A surface of each of the members is affixed to the same surface of another one of the plurality of members along a seam. The seam is spaced apart from the edge of each member and defines a portion of each member between the seam and the edge. The portion of each member between the seam and the edge is divided into a plurality of strips by a plurality of cuts which extend inwardly from the edge to proximate the seam. The present invention may be further characterized as a garment and as a method of forming the camouflage composition.

DETAILED DESCRIPTION OF THE DRAWINGS

Figure 1:
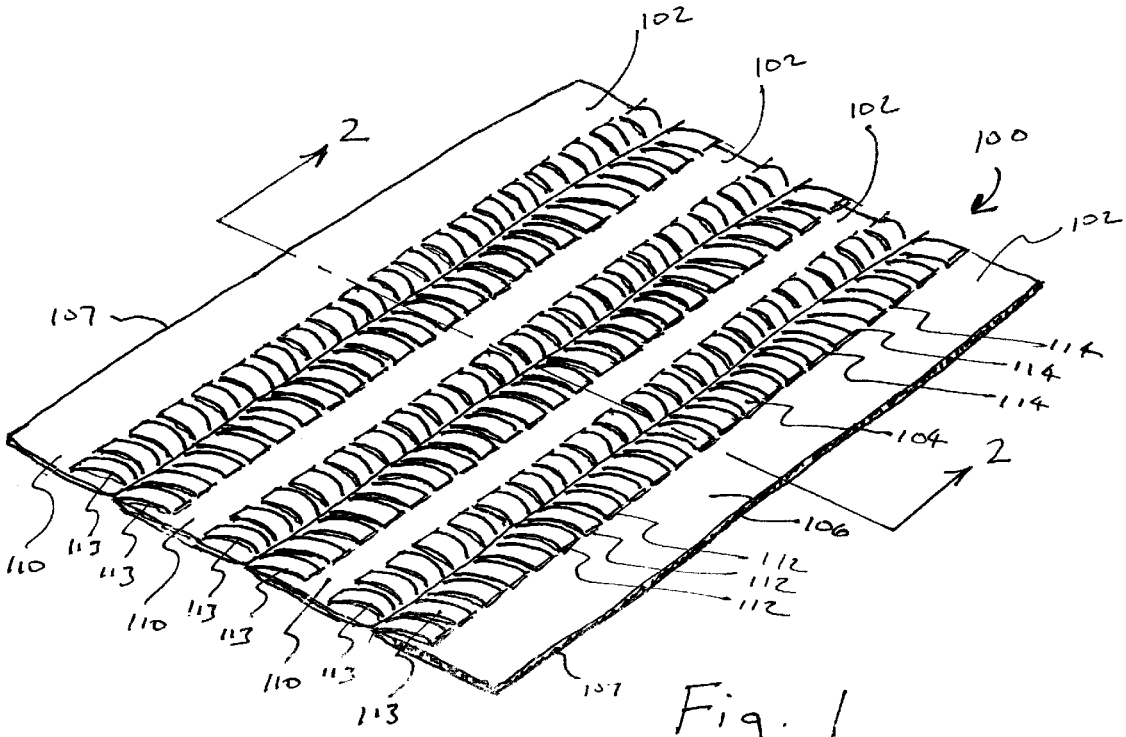
FIG. 1 is a perspective view of the composite camouflage composition of the present invention.
Figure 2:
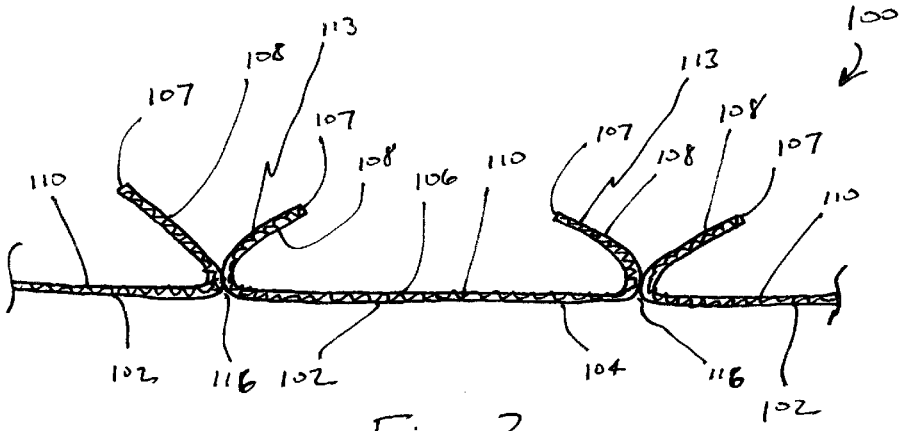
FIG. 2 is a sectional view taken along the section line 2—2 of FIG. 1.

In FIGS. 1 and 2 there is shown generally a composite camouflage composition 100 according to the present invention. The composition 100 is comprised of generally rectangular camouflage material members 102 which may be fabric strips. Each member has a pair of spaced apart, generally parallel edges 107, a first (upper) surface 104 and a second (lower) surface 106. Each member 102 has at least one margin 108 which is formed into strips 112. Each member 102 is thus divided into a body portion 110 and at least one fringe portion 113. Certain members 102 have two generally parallel spaced apart fringes 113.

Camouflage material members 102 are preferably imprinted with any desired camouflage print, but may also be dyed a single color. Although members 102 may be formed from any suitable material, it is currently most preferred that they be formed from a thin woven fabric made from textile yarn, such as nylon, polyester, or the like. The material used for members 102 preferably has a relatively small mesh although a closed material may be used as well, including being closely woven. The material used for members 102 preferably allows the free passage of air, while at the same time forming a barrier to bothersome insects including flies, mosquitoes, and ticks. It is most preferred that a material be selected that allows water vapor, such as human perspiration to pass outward, but that prevents the passage of water droplets as from rain or snow from passing inward.

Figure 3:
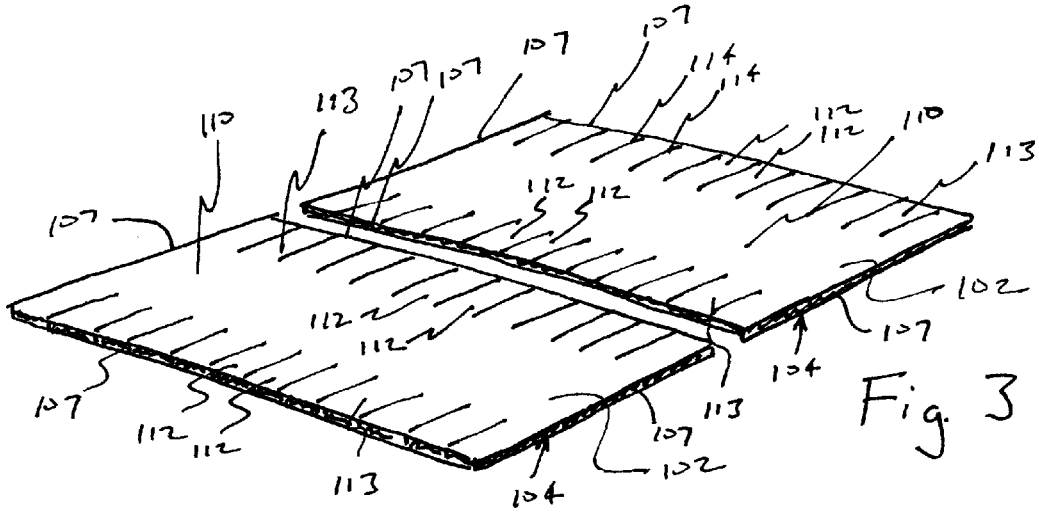
FIG. 3 is a respective view of the separate members of the camouflage composition shown oriented prior to assembly.
Figure 4:
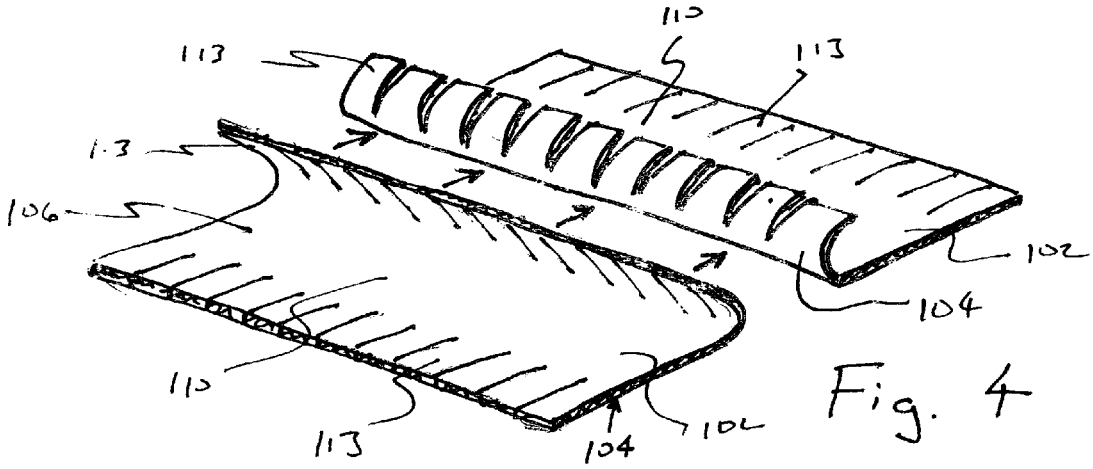
FIG. 4 is a view of the members shown in FIG. 3 in a stage of assembly.
Figure 5:
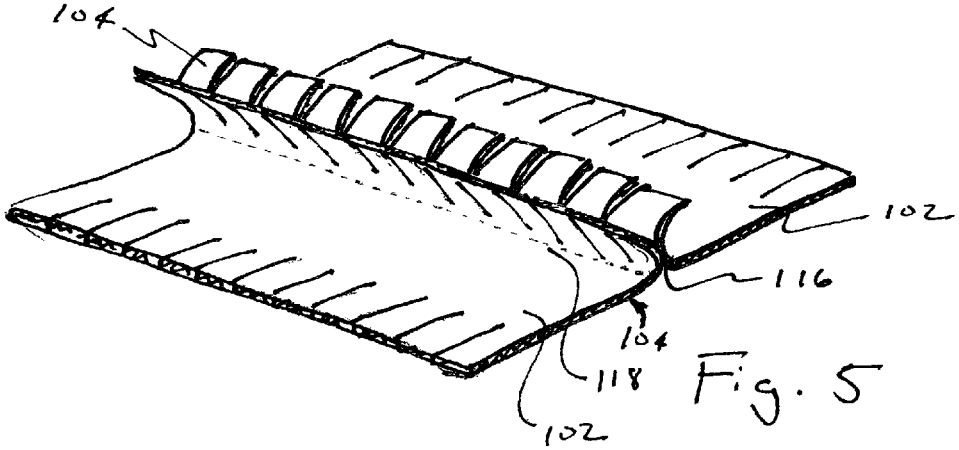
FIG. 5 is a view of the members after assembly.
Figure 6:
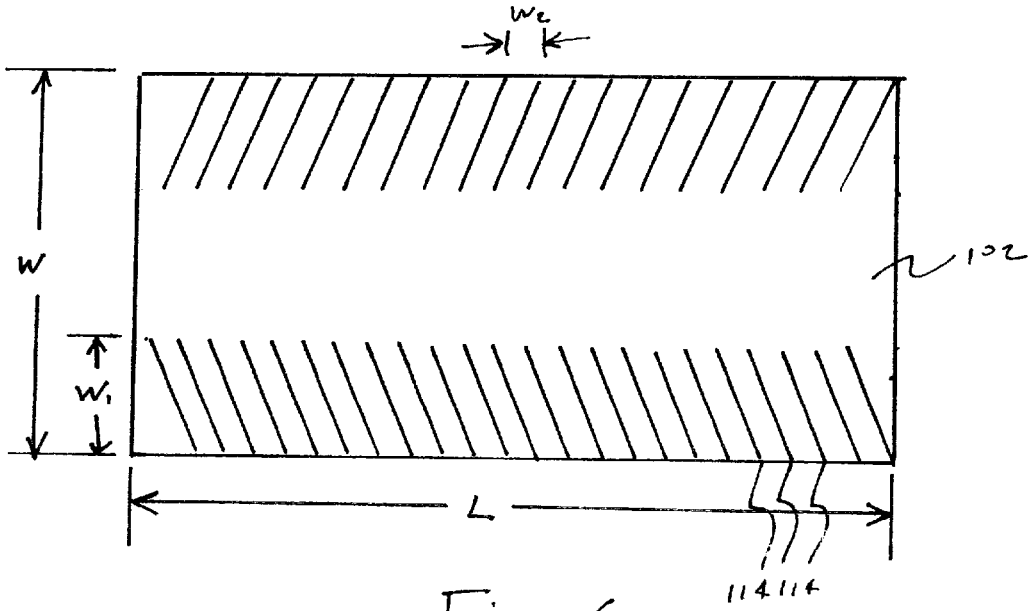
FIG. 6 is a plan view of one member of the composite camouflage composition.
Figure 7:
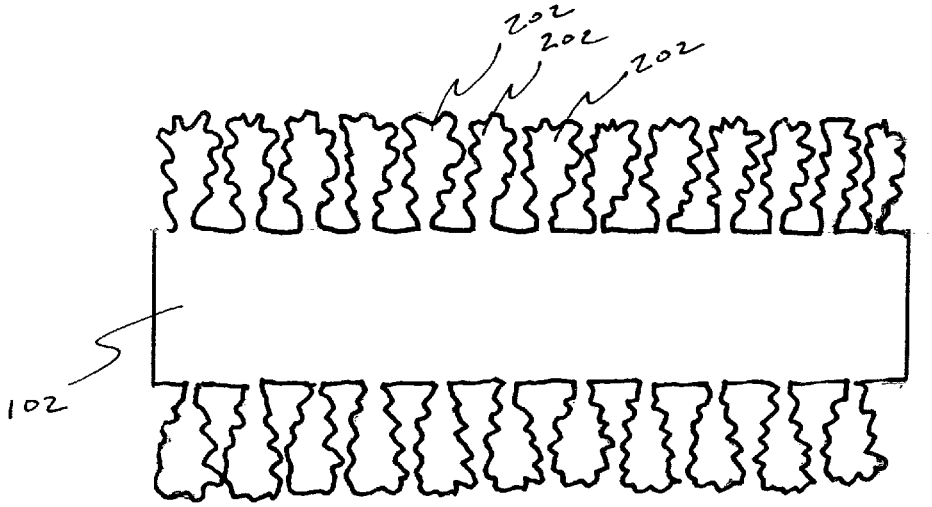
FIG. 7 is a plan view of one member of an alternative embodiment of the present invention.

The construction of camouflage material 100 is shown in FIGS. 2–7. At least one margin 108 of material member 102 is divided into a plurality of strips 112 made by cuts 114 extending inwardly from edge 107 to form a fringe 113. It is most preferred that cuts 114 be oriented diagonally with respect to the longitudinal axis of member 102 as shown in FIG. 6, but the cuts 114 may also be made substantially perpendicular as shown in FIGS. 3–5. In addition, the strips 112 may be formed into any desired shape, for example a leaf shape 202 as shown in FIG. 7.

Camouflage composition 100 is formed by turning up the margins 108 of each member 102, placing the first surface 104 of each member 102 in contact along seam 116, and affixing the members 102 along the seam 116 as shown in FIGS. 3–5. Seam 116 is disposed on first surface 104 of each member 102 along and just inward of margin 108 and preferably extends for substantially the length of member 102. The result is a continuous camouflage material formed by body portions 110 of joiner strip members 102 and that has a three-dimensional effect formed by fringes 113 which tend to project outward from the seam 116. Currently it is most preferred that members 102 be fixed together by stitches 118, but any other suitable method such as adhesives, heat bonding, or mechanical fastening may be used. Those of skill in the art will recognize that the fringes 113 may be formed either before or after members 102 are fixed together, but are preferably formed prior to joining the members 102.

Those of skill in the art will also recognize that the relative dimensions of strips 112 may be selected for the most desirable camouflage effect. The relative width of each member 102 is represented in FIG. 6 as dimension W and the relative width of the fringe portion 113 formed by strips 112 is represented by width dimension W1. It is currently most preferred that W1 be in the range from 10 to 40 percent of width dimension W. The width W2 of each individual strip 112 may be selected so as to give each the appearance of a leaf.

Figure 8:
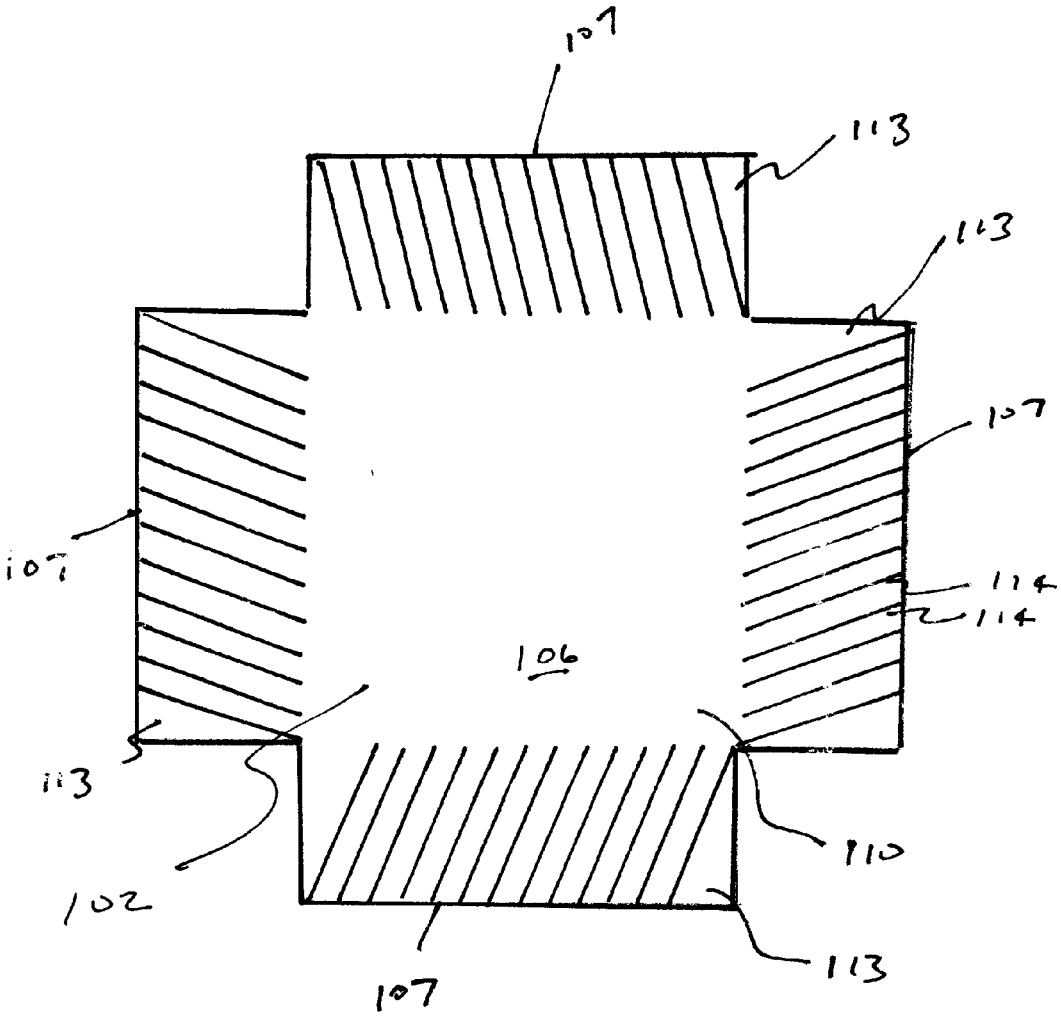
FIG. 8 is plan view of one member of yet another alternative embodiment of the present invention.

An alternative embodiment of member 102 is shown in FIG. 8. In this embodiment, body portion 110 is generally rectangular and margins 108 extend radially therefrom. Again, fringe portions 113 are formed in margins 108 through cuts 114 which form strips 112. This embodiment allows a 3-D camouflage effect to be achieved along transverse as well as longitudinal seams between members 102.

Figure 9:
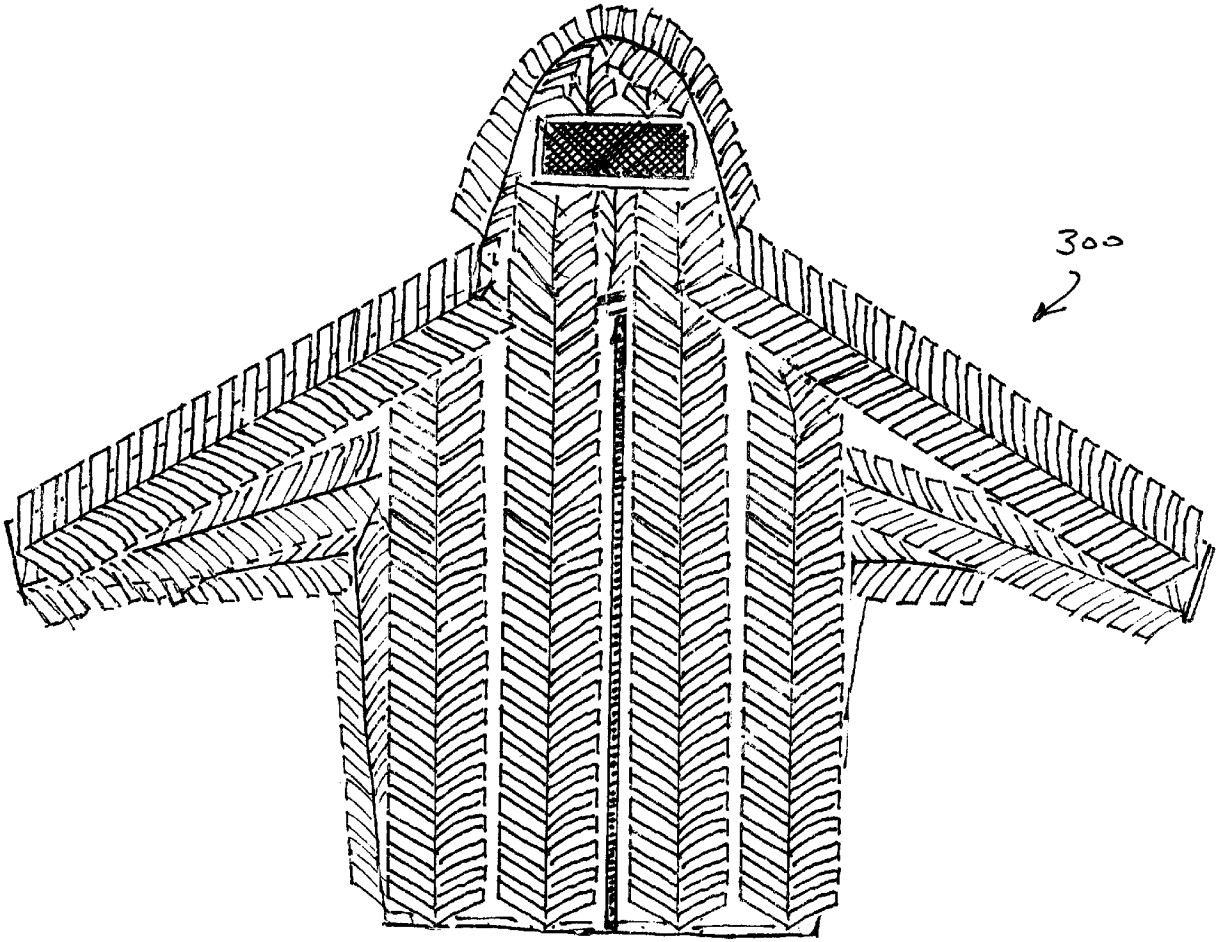
FIG. 9 is a view of a garment constructed according to the present invention.

The camouflage composition 100 can be formed into a multiplicity of different products including, but not limited to, garments such as jackets, pullovers, parkas, coveralls, bibs and pants. For example, camouflage composition 100 may be used to form a garment 300 such as shown in FIG. 9, or may be used to form a garment in accordance with the teachings of U.S. Pat. No. 5,695,835, which is owned by the Assignee of the present application and incorporated herein by reference. Garment 300 may be provided with a suitable lining, which may have any desired properties such as moisture and insect resistance and thermal insulative properties.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A camouflage composition comprising:

A plurality of camouflage material members each having a first surface and an edge, the first surface of each of said plurality of camouflage material members affixed to the first surface of another one of said plurality of camouflage material members along a seam, said seam being spaced apart from the edge of each camouflage material member and defining a portion of each camouflage material member between said seam and the edge, said portion of each of camouflage material member defining a fringe, whereby said plurality of camouflage material members form continuous material and said fringe extends outward from said sheet of material thereby forming a three-dimensional camouflage effect.

2. The camouflage composition of claim 1, the camouflage material members bearing the imprint of a select camouflage pattern.

3. The camouflage composition of claim 1, the camouflage material members being a woven fabric material.

4. The camouflage composition of claim 1, wherein the fringe is defined by a plurality of cuts, each of said plurality of cuts being diagonal with said edge.

5. The camouflage composition of claim 1, wherein the fringe is defined by a plurality of cuts, each of said plurality of cuts forming a substantially leaf shaped pattern of material.

6. The camouflage composition of claim 1, wherein said camouflage material members are affixed together with stitches along said seam.

7. The camouflage composition of claim 1, wherein each of said plurality of camouflage material members has a width dimension, and wherein the width of the portion of each camouflage material member between said seam and the edge is within the range of from 10% to 40% of said width dimension.

8. A composite camouflage composition comprising:

a plurality of generally rectangular fabric members, each having a first surface, a width, and a length, at least one margin of each fabric member being formed in a fringe, the first surface of each of said fabric members affixed to the first surface of a separate one of said plurality of fabric members along a seam, said seam extending substantially the length of each fabric member, each of said fabric members disposed so that the at least one margin of each fabric strip faces the at least one margin of an adjacent one of said plurality of fabric members, whereby said plurality of fabric members forms a continuous material, and said plurality of strips extending outward from the material to form a three-dimensional camouflage composition.

9. The composite camouflage composition of claim 8, the fabric members bearing the imprint of a select camouflage pattern.

10. The composite camouflage composition of claim 8, the fabric members being a woven material.

11. The camouflage composition of claim 8, each of said plurality of strips being formed in a substantially leaf shaped pattern.

12. The camouflage composition of claim 8, wherein said fabric members are affixed together with stitches along said seam.

13. The camouflage composition of claim 8, wherein each of said plurality of strips has a length, said length being in the range of from 10% to 40% of the width of the fabric member.

14. A camouflage composition comprising:

a plurality of fabric strips, each strip having a body portion and at least one fringed portion, said at least one fringed portion arranged along a margin of the strip, the first surface of the body portion of each fabric strip affixed to the first surface of the body portion of a separate one of said plurality of fabric strips along a seam, said seam being oriented adjacent said fringed portion of each strip, whereby the body portions of each of said plurality of fabric strips form a continuous material and said fringed portions extend outwardly from said continuous material to form a three-dimensional camouflage effect.

15. The camouflage composition of claim 14, the fabric strips bearing the imprint of a select camouflage pattern.

16. The camouflage composition of claim 14, the fabric strips being a woven material.

17. The camouflage composition of claim 14, wherein said fringed portion comprises a plurality of individual strips.

18. The camouflage composition of claim 17, wherein the longitudinal axis of each of said plurality of individual strips is substantially perpendicular with the longitudinal axis of the fabric strip.

19. The camouflage composition of claim 17, wherein the longitudinal axis of each of said plurality of individual strips is oriented diagonally with the longitudinal axis of the fabric strip.

20. The camouflage composition of claim 17, wherein each of said plurality of individual strips is formed in a substantially leaf shaped pattern.

21. The camouflage composition of claim 14, wherein said camouflage material members are affixed together with stitches along said seam.

22. The camouflage composition of claim 14, wherein each of said plurality of fabric strips has a width, wherein said fringed portion has a width, and wherein the width of said fringed portion is within the range of from 10% to 40% of the fabric strip width.

23. A garment comprising:

formed at least in part from a three-dimensional camouflage composition, the three-dimensional camouflage composition having a plurality of camouflage material members each having a first surface and an edge, the first surface of each of said plurality of camouflage material members affixed to the first surface of another one of said plurality of camouflage material members along a seam, said seam being spaced apart from the edge of each camouflage material member and defining a portion of each camouflage material member between said seam and the edge, said portion of each of camouflage material member being divided into a plurality of strips by a plurality of cuts extending inwardly from the edge to proximate said seam.

24. The garment of claim 23, the three-dimensional camouflage material members bearing the imprint of a select camouflage pattern.

25. The garment of claim 23, the three-dimensional camouflage material members being a woven fabric material.

26. The garment of claim 23, wherein each of said plurality of cuts is substantially perpendicular with said edge.

27. The garment of claim 23, wherein each of said plurality of cuts is diagonal with said edge.

28. The garment of claim 23, each of said plurality of strips being formed in a substantially leaf shaped pattern.

29. The garment of claim 23, wherein said camouflage material members are affixed together with stitches along said seam.

30. The garment of claim 23, formed in part by a two-dimensional camouflage material.

31. The garment of claim 23, further comprising a lining within at least a portion of the garment.

32. The garment of claim 31, wherein said lining is pervious to water vapor and impervious to water droplets.

33. The garment of claim 31, wherein said lining has thermal insulative properties.

34. A method of making a composite camouflage composition comprising:

providing a plurality of fabric members, each having a first surface;

forming a plurality of strips at least one margin of each member; and affixing the first surface of each of said plurality of fabric members to the first surface of a separate one of said plurality of fabric members along a seam, the seam being disposed on each member along and inward from said plurality of strips.

35. The method of claim 34, further comprising the step of imparting the imprint of a select camouflage pattern on the fabric strips.

36. The method of claim 34, wherein each of said plurality of strips is formed in a substantially leaf shaped pattern.

37. The method of claim 34, wherein said fabric members are affixed with stitches along said seam.

38. The method of claim 34, wherein the fabric members are formed of a material pervious to water vapor and impervious to water droplets.

39. The method of claim 34, wherein said fabric strips are formed of a woven material.

* * * * *